United States Patent [19]

Coulter

[11] 3,986,309

[45] Oct. 19, 1976

[54] SWIMMING POOL CONSTRUCTION

[76] Inventor: Terrance Douglas Coulter, 2066 Neris Court, Mississauga, Ontario, Canada

[22] Filed: Apr. 7, 1976

[21] Appl. No.: 674,661

[52] U.S. Cl. ..... 52/166; 52/169 R

[51] Int. Cl.[2] ..... E04H 3/18

[58] Field of Search ..... 52/169, 166, 588; 4/172.19, 172.21

[56] References Cited

UNITED STATES PATENTS 3,444,659 5/1969 Shanni ..... 52/169

R26,977 11/1970 Pereira ..... 4/172.19

*Primary Examiner*—John E. Murtagh

[57] ABSTRACT

An improved system of anchoring the bottom ends of interlocking wall panels in an aluminum swimming pool construction is disclosed, in which vertical anchors of reentrant cross section engage vertically extending peninsular projections of the rear of the panels, some at least of these projections being formed by interengagement of parts of adjacent panels, or panels and corner pieces. The anchors thus both anchor the panels and lock them together.

4 Claims, 6 Drawing Figures

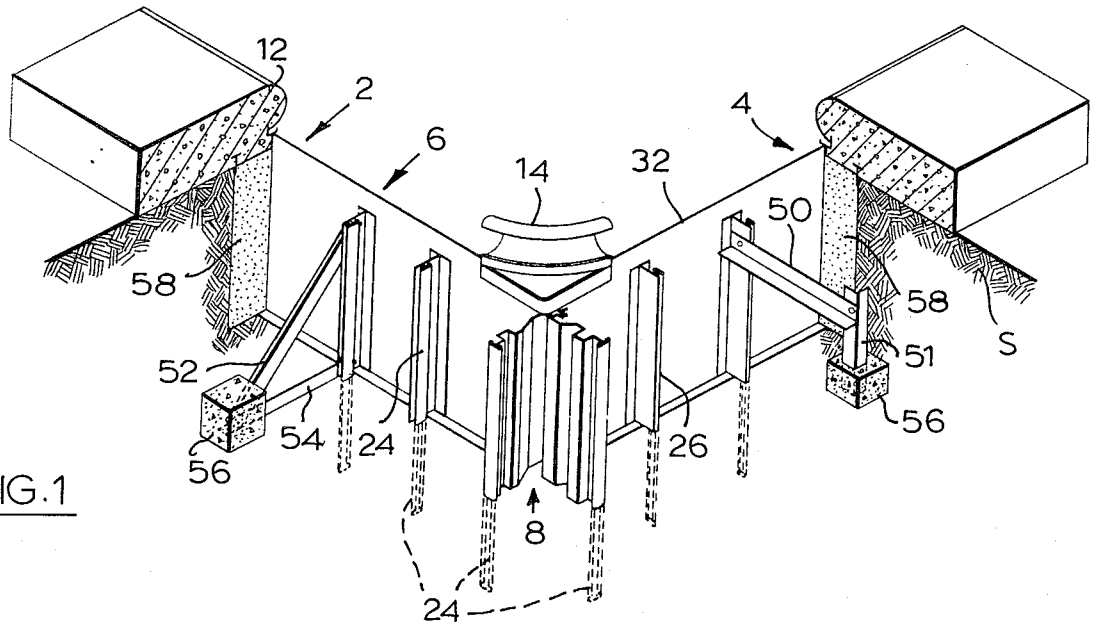
FIG. 1
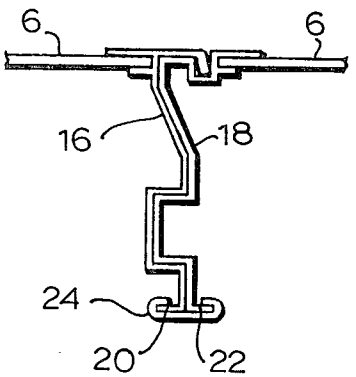
FIG. 2
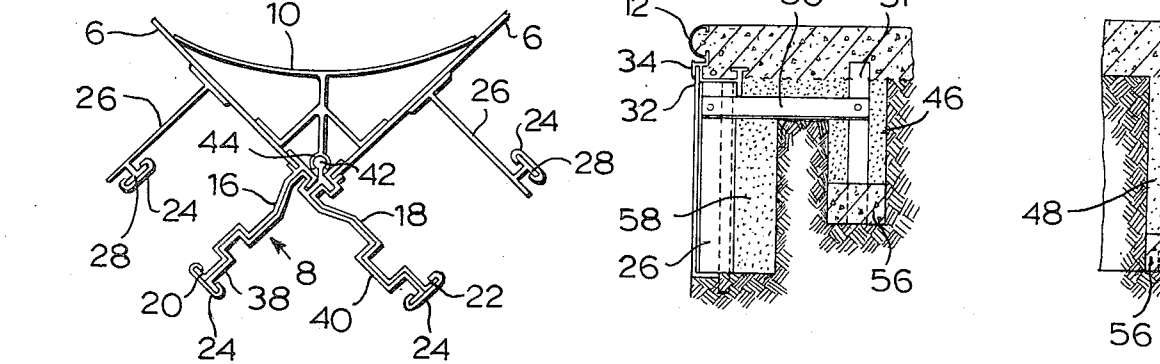
FIG. 3
FIG. 4
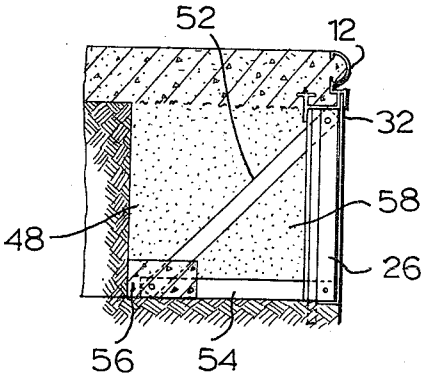
FIG. 5
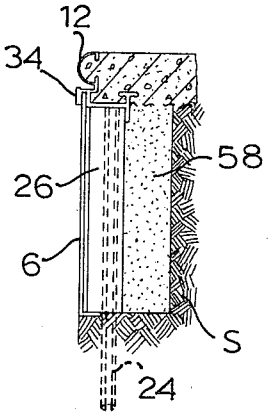
FIG. 6

SWIMMING POOL CONSTRUCTION

FIELD OF THE INVENTION

This invention relates to swimming pools of the type in which the side walls of the pool are formed by interlocking metal, normally aluminum panels, the panels being supported from behind and anchored beneath within a suitable excavation. A further plastic lining or shell may be provided within the walls.

REVIEW OF THE PRIOR ART

A swimming pool structure of the general type to which the present application relates is described in U.S. Pat. No. 3,812,633 issued May 28, 1974 to Shanni et al, more particularly the embodiments of FIGS. 1–3 of that patent. The interlocking wall panels are located at their lower ends by pins driven through vertical sleeves formed on the rear side of the panels, and at their upper ends by struts taken rearwardly to poured concrete ground anchors. This form of construction enables a pool to be constructed with the minimum of over-excavation of the pool site, and simplifies erection of the pool by anchoring the bottom ends of the panels and supporting them while the struts are installed.

SUMMARY OF THE INVENTION

An object of the present invention is to provide a swimming pool construction having an improved means of anchoring the lower ends of the panels which still further facilitates erection. The invention provides a swimming pool construction comprising a plurality of interlocking metal side wall members extending around the inner periphery of an excavation, struts extending outwardly from the wall members to ground anchors outside the periphery of the excavation, and anchor posts in sliding engagement with the rear of the wall members and extending vertically downward beyond the bottom edges of the wall members through the bottom of the excavation, wherein the anchor posts are of reentrant cross section and slidingly embrace vertically extending projections of peninsular cross section formed on the outside faces of the interlocking wall members, some at least of said projections being formed by cooperant portions of two adjacent wall members whereby said cooperant portions are locked together.

It will thus be appreciated that the anchor posts can serve not only to anchor the wall members but also to anchor them together. This arrangement is particularly advantageous at the corners of a pool. Known corner structures have in general required the use of bolts for their assembly, and whilst a sufficient degree of interlocking between adjacent panels can be achieved to avoid the necessity for bolts to retain alignment between the panels once erected, the positive connection between panels provided by the present invention is more secure and facilitates assembly. The elimination of bolts is advantageous, because they are relatively expensive, time consuming to install, and provide a potential corrosion problem.

SHORT DESCRIPTION OF THE DRAWINGS

A preferred embodiment of the invention is illustrated in the accompanying drawings, in which:

FIG. 1 is a perspective, partially cut away view of a corner of a swimming pool embodying the construction of the invention, FIG. 2 is a plan view illustrating the interlocking engagement of two adjacent side panels of the pool, FIG. 3 is a plan view illustrating the interlocking engagement of members forming a corner of the pool, FIGS. 4 and 5 are vertical cross sections through a side wall of the pool, illustrating alternative arrangements of bracing struts, and FIG. 6 is a vertical cross section through a side wall of the pool, illustrating one mode in which an anchor post is used to anchor a wall panel.

DESCRIPTION OF THE PREFERRED EMBODIMENT

The side walls 2 and 4 (and the remaining side walls, not shown) of a swimming pool are formed by a plurality of wall panels 6, together with corner members 8, the corners being finished by corner mouldings 10. The panels are topped by coping members 12 and the corner mouldings by corner copings 14.

The panels 6 comprise aluminum sheets with extruded aluminum end members 16 and 18, which are of complementary interlocking configuration as best seen in FIG. 2. The outer ends of the end members 16 and 18 have out-turned flanges 20 and 22 which cooperate to form a vertically extending strut of peninsular cross section. The end members of adjacent panels are locked together by a C-shaped extruded aluminum anchor post 24 whose reentrant cross section embraces the flanges 20 and 22. As seen in FIG. 1, the anchor posts 24 are of sufficient length that they may slide over the flanges and be driven downwardly into the soil beneath the excavation in which the pool is erected. The panels 6 are also provided with further extruded aluminum vertical brace members 26 which have T-shaped peninsular section vertically extending struts 28 embraced by further anchor posts 24 (see FIGS. 1 and 6) extending into the soil S beneath the excavation. The panels 6 have out-turned flanges 30 at their lower edges, and their upper edges 32 extend above the upper ends of the members 16, 18 and 26 so as to enter sockets 34 in the coping members 12, which latter also have bottom flanges 36 resting on the tops of the members 16, 18 and 26.

At the corners of the pool, the corner members 8 are extrusions having perpendicular side arms 38 and 40 configured to interengage with the members 16 and 18 of adjacent side members and cooperate with the flanges 20 and 22 thereof to provide peninsular section vertical struts embraced by anchor posts 24 in the same manner as previously described. Each corner member 8 has an inwardly directed vertically extending spigot 42 which passes between the panels to either side of the corner and engages a socket 44 in the associated corner moulding 10 so as to retain the latter in place.

In erecting a pool according to the invention, an appropriate excavation is formed, with no more than a few inches of overdig behind the rear of the outer periphery of the pool walls except for pits 46 (see FIG. 4) or trenches 48 (see FIG. 5) to accommodate struts 50 and 51 or 52 and 54 used to support the panels 6 from poured concrete ground anchors 56. The panels 6 and corner members 8 are then erected to form the side walls of the pool, the anchor members being used to hold in position and interlock the panels and corner members, and the corner mouldings 10 are inserted. The struts 50 and 51 or 52 and 54 are positioned and the ground anchors 56 are poured, and the copings 12 and 14 are fitted. The spaces behind the panel are then filled with soil 58, and further concrete 60 is poured behind the copings to form the pool surround.

What I claim is:

1. In a swimming pool construction comprising a plurality of interlocking metal side wall members extending around the periphery of an excavation, struts extending outwardly from the wall members to ground anchors outside the periphery of the excavation, and anchor posts in sliding engagement with the rear of the wall members and extending vertically downward beyond the bottom edges of the wall members into unexcavated soil, the improvement wherein the anchor posts are of reentrant cross section and slidingly embrace vertically extending struts of peninsular cross section formed on the outside faces of the wall members, said projections including projections formed by cooperant portions of two adjacent side wall members whereby said cooperant portions are locked together.

2. A swimming pool construction according to claim 1, wherein the side wall members include wall panels and corner members, and each corner member has perpendicular outwardly projecting limbs each interlocking with an end of an adjacent wall panel and cooperating therewith to form a peninsular section strut which is embraced by one of the anchor posts.

3. A swimming pool construction according to claim 2, wherein the corner members each have a further, inwardly projecting limb passing between the adjacent wall panels, and a corner moulding is retained in the corner formed by said panels by said limb.

4. A swimming pool construction according to claim 2, wherein the wall panels have intermediate vertical brace members on their outside surfaces, the brace members include vertical struts of peninsular cross section, and the vertical struts on the brace members are slidably embraced by further of said reentrant section anchor posts.

* * * * *